United States Patent [19]

Sata et al.

[11] 4,431,604

[45] Feb. 14, 1984

[54] PROCESS FOR PRODUCING HARD MAGNETIC MATERIAL

[75] Inventors: Takeo Sata; Masayuki Takamura; Toshiharu Hoshi, all of Hamamatsu, Japan

[73] Assignee: Nippon Gakki Seizo Kabushiki Kaisha, Japan

[21] Appl. No.: 226,923

[22] Filed: Jan. 21, 1981

[30] Foreign Application Priority Data

Jan. 24, 1980 [JP] Japan ..... 55-6369

[51] Int. Cl.[3] ..... B22F 1/02

[52] U.S. Cl. ..... 419/23; 419/28; 419/26; 419/35; 148/120

[58] Field of Search ..... 75/212, 214; 29/420.5; 264/176 R, 320, 325; 148/104, 105, 120; 419/23, 28, 26, 35

[56] References Cited

U.S. PATENT DOCUMENTS 1,986,197 1/1935 Harshaw ..... 75/212

FOREIGN PATENT DOCUMENTS 566352 11/1958 Canada ..... 75/212
51-21947 of 0000 Japan .
811935 4/1959 United Kingdom ..... 75/212
779969 7/1957 United Kingdom ..... 75/212

*Primary Examiner*—Jack Cooper
*Attorney, Agent, or Firm*—Lerner, David, Littenberg, Krumholz & Mentlik

[57] ABSTRACT

In production of so-called anisotropic fine gain type hard magnetic material, particles of highly magnetic substance powder are each plated with nonmagnetic substance before compaction, sintering and plastic deformation in order to provide the product with stable magnetic characteristics for reduced production cost.

4 Claims, 9 Drawing Figures

PROCESS FOR PRODUCING HARD MAGNETIC MATERIAL

BACKGROUND OF THE INVENTION

The present invention relates to a process for producing hard magnetic material, and more particularly relates to a process for producing so-called anisotropic fine grain type hard magnetic material in which fine grains each corresponding to a unit magnetic domain are dispersed with shape anisotropy into a nonmagnetic base.

It is well known to public to produce hard magnetic material with magnetic anisotropy and high magnetic characteristics by dispersing with prescribed orientation into a base of nonmagnetic substance such as Cu, Al and Sn anisotropic fine grains of highly magnetic or ferromagnetic substance such as Fe, Co, Ni and Fe-Co alloys, each grain corresponding to a unit magnetic domain.

In one actual process for production of such hard magnetic materiai, cast Fe-Ni-Al-Co type alloy, or like alloy further including Cu, Ti and/or Nb, is thermally treated within magnetic field in order to cause so-called spinodal decomposition which eventuates in dispersed separation of highly magnetic, fine grains with shape anisotropy within a nonmagnetic phase. This process, however, results in high material cost due to use of costy metals such as Co and Ni. In addition, the thermal treatment within magnetic field requires use of an exorbitant equipment, and causes high process cost and low productivity. Further, the hard magnetic material produced by this process is too hard and fragile to be worked and/or cut smoothly.

In another actual process for production of the above-described hard magnetic material, fine, spherical Fe grains, each having a diameter in a range from 15 to 30 mm and corresponding to a unit magnetic domain, are obtained by a reduction process. Such Fe grains are then blended with grains of nonmagnetic metal such as Al, and the resultant blend is subsequently subjected to compaction and sintering.

In the case of this process, however, it is extremely infeasible to prepare fine grains of uniform diameter, each corresponding to a unit magnetic domain, since such fine grains easily aggregate even in a free state due to mutual magnetic attraction. Relatively large specific surface area of each fine grain tends to cause oxidization of the grains, which disables easy and simple handling of the substance. Oxidization of the substance seriously degrades saturated magnetic flux density Bs and $4\pi$ Is of the resultant, sintered material. Such oxidization further impairs affinity of the grains with the grains of nonmagnetic substance, thereby seriously deteriorating mechanical strength of the obtained sintered body. I11 spinal rotation due to presence of the spherical grains is liable to connect to unstable magnetic characteristics of the product.

In the other actual process of the above-described hard magnetic material, long and thin Fe fine grains or Fe-Co alloy fine grains are separated on Hg electrodes by electrolysis which are then dispersed into nonmagnetic substance, the blend is processed to compaction for orientation of the Fe fine grains, and the compacted body is subjected to sintering. Although this process significantly improves magnetic characteristics of the product, it is still very difficult to obtain, at high efficiency, fine grains of uniform dimension. Further, this process, just like the foregoing instance, cannot avoid the oxidization troubles.

It is also proposed in actual production of the hard magnetic material of the above-described type to subject a highly magnetic core rod, e.g. an Fe rod, covered with a nonmagnetic sheath, e.g. an Al sheath, to repeated drawings for plastic deformation, which microminiaturizes and disintegrates the highly magnetic substance into mutually separated fine grains, each corresponding to a unit magnetic domain, dispersed within the nonmagnetic base.

In this case, however, high frictional contact between the highly magnetic core covered with the nonmagnetic sheath and the dies disables uniform flow of the substances during the process. Consequently, the highly magnetic fine grains are oriented substantially in parallel to the axial direction of the product in its central section whereas they are arranged at random in the peripheral section of the product. Such untidy arrangement of the highly magnetic fine grains within the obtained structure seriously deteriorates magnetic characteristics of the resultant hard magnetic material. Since it is difficult to design a high rate of cross-sectional reduction for each drawing, drawings have to be repeated several times in order to obtain a product of a desired diameter, thereby considerably raising production cost.

A process for solving such problems has already been proposed by inventors of the present invention in Japanese Publication Sho. No. 51-21947, in which the conventional drawing process is replaced by hydrostatic extrusion process for production of a hard magnetic material. This proposal is based on a recognition that relatively low frictional contact between the work piece and the die allows smooth and tidy flow of the substances and relatively high rate of cross-sectional reduction is employable in the case of the hydrostatic extrusion. In this proposed process, a plurality of elongated highly magnetic cores each covered by nonmagnetic sheath are bundled together and subjected to hydrostatic extrusion for plastic deformation. As a result of such plastic deformation, highly magnetic fine grains, each corresponding to a unit magnetic domain, are oriented and dispersed within the nonmagnetic base so that their longitudinal directions substantially meet the axial direction of the produced hard magnetic material which has a composit structure with shape anisotropy.

This process assures ideal orientation of the fine grains, each corresponding to a unit magnetic domain and, consequently, greatly improved magnetic characteristics of the product. Production requires reduced repetition of the unit operation, i.e. the hydrostatic extrusions, thereby remarkably lowering the production cost.

Further study of this previous process by the inventors, however, has revealed presence of the following disadvantage. As described already, the highly magnetic core, e.g. an Fe rod, is covered with the nonmagnetic sheath such as Al covering in the case of this previously proposed process, prior to the hydrostatic extrusion. More specifically, a Fe rod is inserted into a small/Al cylinder, whose inner wall is covered with $Al_2O_3$ layer, in order to form a composite body. A plurality of such composite bodies are bundled together, inserted into a large Al cylinder and subjected to hydrostatic extrusion for cross-sectional reduction of the composite bodies.

Since each Fe rod is broken into fine pieces during ıe plastic deformation, cross-sectional reduction tends ı vary from piece to piece. Consequently, the Al base the product contains Fe fine grains of different diamers. Some fine grains may be larger in size than the ıit magnetic domain, and uncontrollable presence of ıch large fine grains dispersed in the base leads to ıstable magnetic characteristics of the obtained hard agnetic material. With this previous process, it is alost infeasible to control the hydrostatic extruction so ıat the product should contain Fe fine grains only hich correspond in size to the unit magnetic domain. /hen compared to the conventional production by rawing, use of hydrostatic extrusion remarkably reuces repetition of the unit operation thanks to its relavely large extrusion ratio. Yet, appreciable repetition f the hydrostatic extrusion is necessary to miominiaturize the starting rod to the fine grains each orresponding to a unit magnetic domain. Employment f high rate cross-sectional reduction for hydrostatic ctrusion in this process may limit free choice of the ıbstances to be used due to expected high resistance gainst plastic deformation.

SUMMARY OF THE INVENTION

It is one object of the present invention to produce a ard magnetic material with stable magnetic charactertics.

It is another object of the present invention to prouce a hard magnetic material by hydrostatic extrusion ith appreciably reduced production cost when comared with the previously proposed process by hydroatic extrusion.

It is the other object of the present invention to prouce a hard magnetic material whilst successfully obviting malignant influence of oxidation which is inherent ı the conventional process by powder metallurgy.

In accordance with the basic aspect of the present ıvention, particles of highly magnetic substance power are each plated with nonmagnetic substance in adance to compaction, sintering and plastic deformation ı a prescribed direction so that fine grains of the highly ıagnetic substance are dispersed with shape anisotropy ıto the base of the nonmagnetic substance.

DESCRIPTION OF THE PREFERRED EMBODIMENTS

Figure 1A:
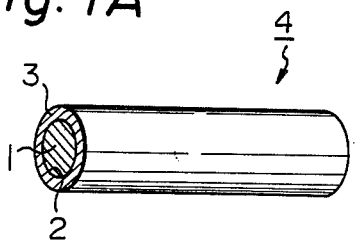
PRIOR ART Fig. 1A
FIG. 1A is a perspective view of the composite body sed for the process proviously proposed by the invenors of the present invention.
Figure 1B:
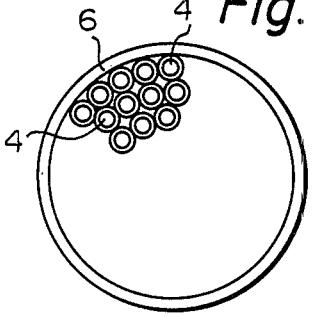
PRIOR ART Fig. 1B
FIG. 1B is an end view of the composite bodies of IG. 1 assembled together for hydrostatic deformation.

As briefly described already, the process previously ıroposed by the inventors of the present invention uses, as the starting material, a composite body 4 such as shown in FIG. 1A, and a plurality of such composite bodies 4 are bundled together and inserted into a large cylinder 6 as shown in FIG. 1B for plastic deformation by hydrostatic extrusion. The composite body 4 may include an Al cylinder 3 internally coated with an $Al_2O_3$ layer 2 and an Fe rod 1 inserted into the Al cylinder 3.

Figure 2:
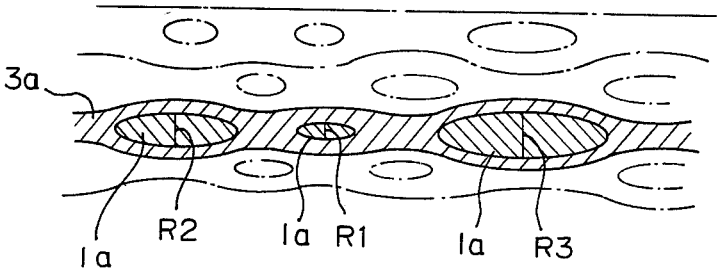
PRIOR ART Fig. 2
FIG. 2 is a cross-sectional model view of the hard ıagnetic material produced by the process previously roposed by the inventors.

Internal structure of a hard magnetic material produced by the above-described process is illustrated in FIG. 2, in which Fe fine grains 1*a* of various diameters R1, R2 and R3 are dispersed in an Al base 3*a*. Some Fe fine grains are larger in size than the unit magnetic domain and their presence in the structure seriously degrades stability in magnetic characteristics of the obtained hard magnetic material.

As a result of repeated study, it was confirmed by the inventors of the present invention that difficulty in cross-sectional reduction to the level of the unit magnetic domain is caused by occurance of slip at the border between Fe and Al during the plastic deformation which seriously barrs uniform application of the deformative force from the die to the Fe component.

In order to prevent such slip, it is effective first to minituarize highly magnetic substance such as Fe to powder particles to an extent larger than the unit magnetic domain and plate such powder particles with nonmagnetic substance such as Cu. Such plated particles are then subjected to plastic deformation in a prescribed direction after compaction and sintering so that the highly magnetic powder particles are elongated in the direction at uniform rate of cross-sectional direction without any slip at the border between the two substances.

Metals such as Fe, Co, Ni and alloys including two or more of them are advantageously used for the highly magnetic or ferromagnetic substance in the process of the present invention, and metals such as Cu, Al Sn, Pb, Zn and combination of these metals are advantageously used for the nonmagnetic substance. Combination of these substances should be small in solid solution limit so that no separate phase should be developed in sintering due to excessive dispersion at the border between the highly magnetic and nonmagnetic substances. For example, combination of Fe with Cu is ideal.

It was experimentally confirmed that combinations of ferromagnetic and nonmagnetic substance such as shown in the following table brought about highly improved magnetic characteristics of the product as shown in FIGS. 5 through 8.

| Combination | Volume occupation ratio of Fe in % |
|---|---|
| Fe/Cu | 10 to 85 |
| Fe/Pb | 10 to 85 |
| Fe/Sn | 10 to 80 |
| Fe/Zn | 10 to 80 |

Here, the term "Volume occupation ratio of Fe" refers to percent volume content of Fe in the volume of the combination.

Preparation of the starting highly magnetic powder particles is carried out in various known ways such as carbonyl powder production methods and atomization methods. In order to successfully obtain final grains each corresponding to a unit magnetic domain, it is advantageous to prepare powder particles of substantially similar diameters by proper filtering.

The particle diameter should preferably in a range from 1 to 1,000 μm, and more favourably from 5 to 150 μm. Any particle diameter smaller than 1 μm tends to cause aggregation of the powder particles which seriously hinders preparation of particles of uniform diameter by the filtering. Such small particle size also causes easy oxidization of the highly magnetic substance, thereby impairing the magnetic characteristics of the product. Whereas any particle diameter larger than 1,000 μm calls for increased repetition of the treatment necessary for microminiaturization to the unit magnetic domain level, thereby increasing the production cost. During the subsequent plastic deformation, cross-sectional reduction elongates each powder particle in the direction of orientation in order to improve its magnetic characteristics. But, since this effect saturates beyond the particle diameter of 1,000 μm, there is no significance in further enlarging the particle diameter.

Although it is usual to use highly magnetic powder particles of spherical shapes, particles like short fibers may be used depending on the situation.

The highly magnetic powder particles are plated with the nonmagnetic substance by, for example, nonelectrolytic plating. More specifically, when Fe is used for the highly magnetic substance and Cu is used for the nonmagnetic substance, Fe powder particles are added to copper salt solution such as copper sulfate solution which contains about 0.5 to 100 g/l of copper and 0.05 to 10% of sulfuric acid as a reaction accelerator. Then Fe particles are plated with Cu due to the following substitution reaction.

$$Cu^{++}+Fe \rightarrow Cu\downarrow+Fe^{++}$$

In this case, the quantity of the Fe particles to be added is about 20 times of the chemical equivalent necessary for the substitution. Next, the Cu plated particles are subjected to appropriate clensing and drying. When required, they may be subjected to reduction within a reducing gas environment such as $H_2$ gas.

Figure 3:
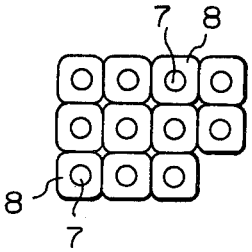
FIG. 3 is an end view of the sintered bodies obtained ı the process of the present invention.

After the above-described plating with nonmagnetic substance such as Cu, the plated Fe particles are subjected to compaction such as hydrostatic extrusion, and further to sintering within a non-oxidizable environment such as $H_2$ gas. Process conditions for this sintering differ depending on the type of combination of the starting substances. In the case of Fe particles plated with Cu, sintering is preferably carried out at a temperature in a range from 450° to 950° C. for 0.5 to 5 hours. The cross-sectional structure of the resultant sintered body is shown in FIG. 3, in which Fe fine grains 7 are wholly covered with Cu plates 8.

Figure 4:
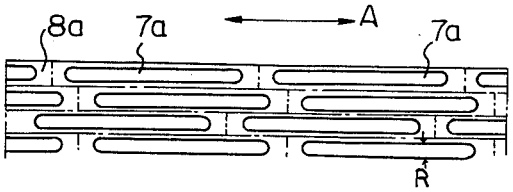
FIG. 4 is a cross-sectional model view of a hard magetic material in accordance with the present invention, nd
Figure 5:
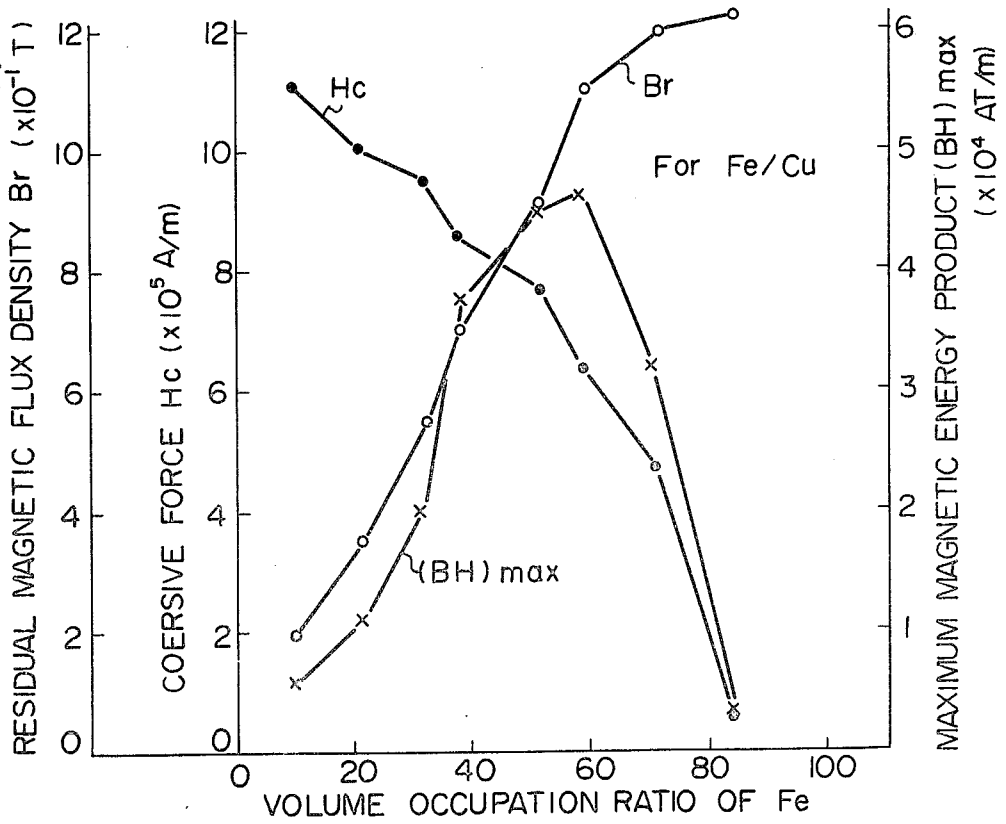
FIGS. 5 through 8 are graphs for showing magnetic haracteristics of the obtained hard magnetic material or various combinations of Fe with nonmagnetic metls.
Figure 6:
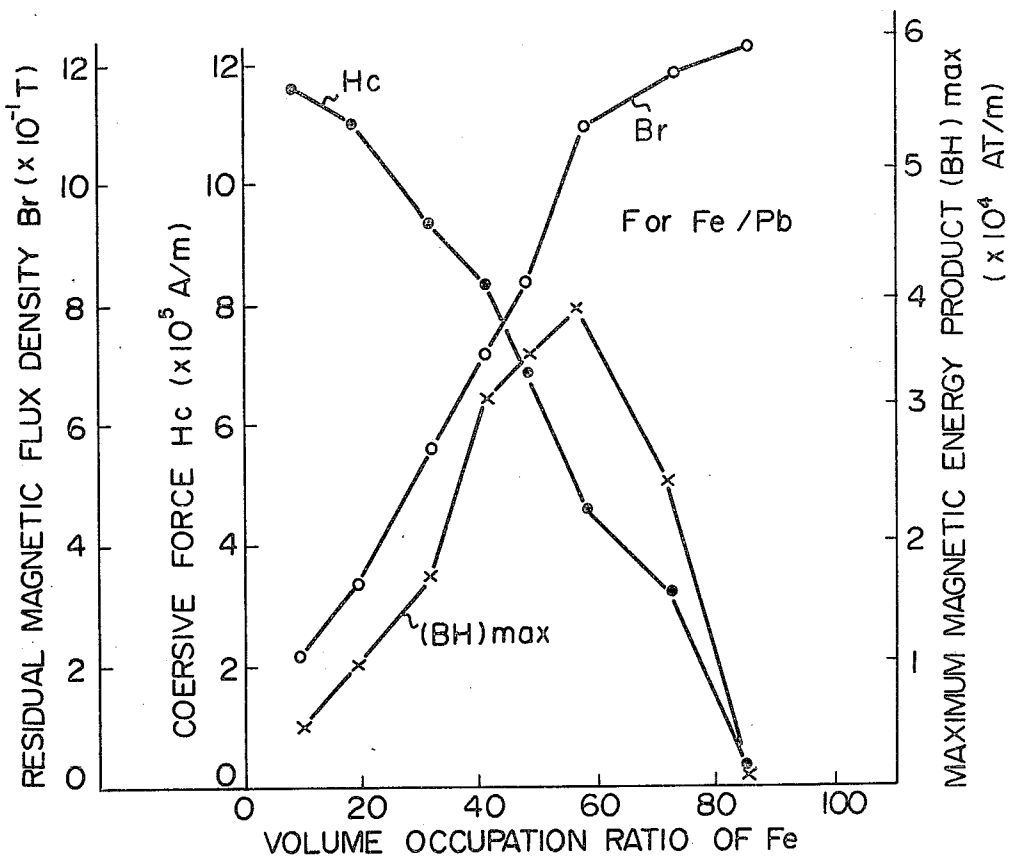
Figure 7:
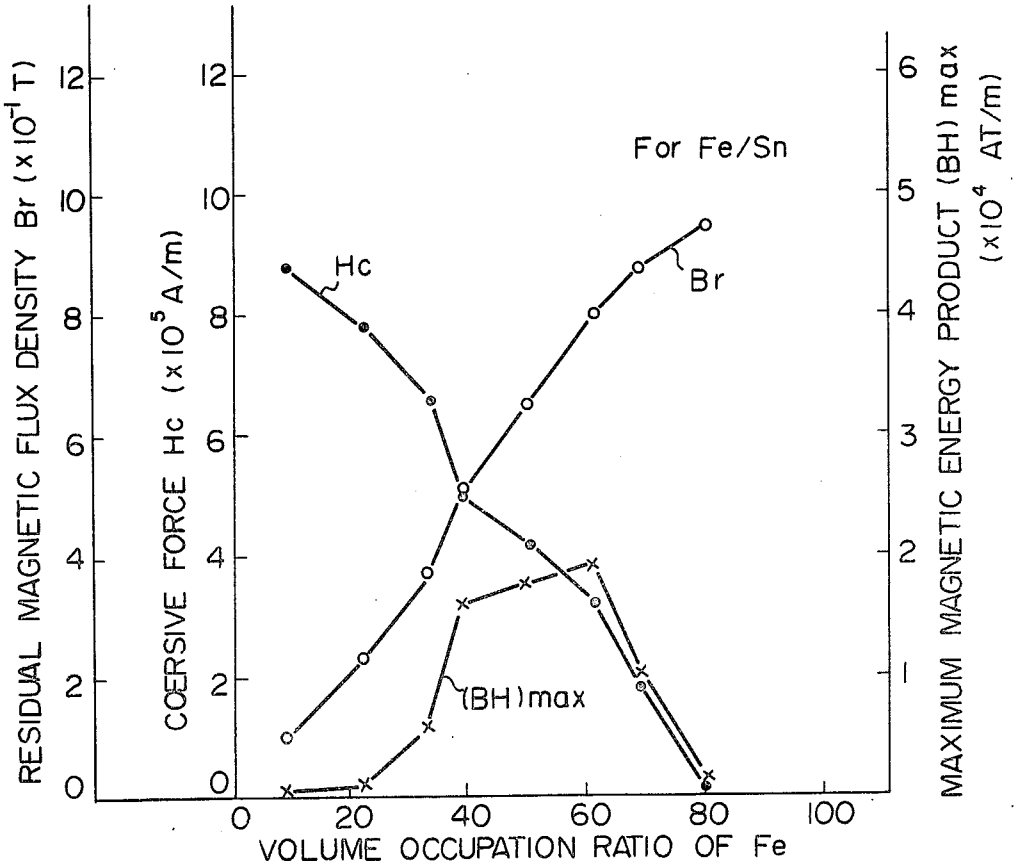
Figure 8:
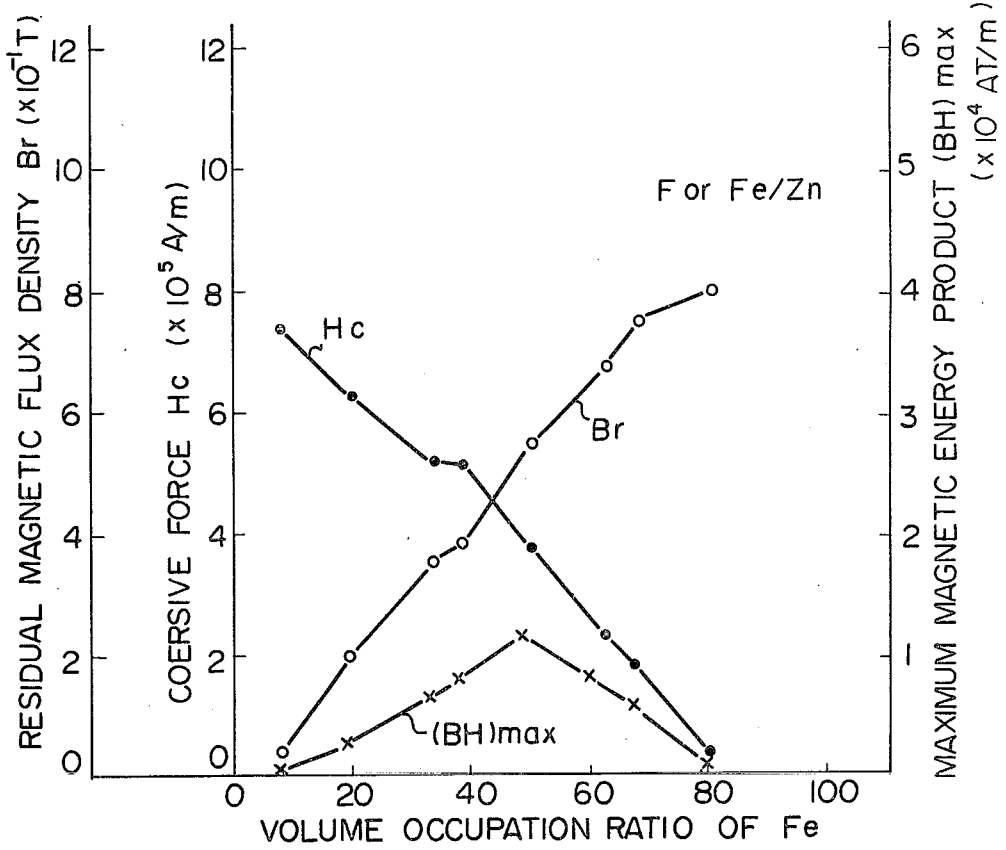

Next, the sintered body is subjected to plastic deformation in a prescribed direction such as hydrostatic extrusion. After the deformation, the material has a structure shown in FIG. 4, in which highly magnetic fine grains *7a* of substantially uniform diameter R are dispersed and oriented within a nonmagnetic base *8a* whilst extending in the direction of extrusion A.

This plastic deformation may be carried out by extrusion other than hydrostatic or drawing also either in hot or cold state. Hydrostatic extrusion, however, is advantageous since it allows employment of large extrusion ratios. In addition, extremely low frictional contact between the die and the sintered work piece allows, even in the peripheral section of the work piece, flow of the substances in parallel to the axis of the work piece, which eventuates in tidy and uniform orientation of the highly magnetic fine grains, thereby assuring improved magnetic characteristics of the resultant hard magnetic material.

The above-described plastic deformation should be carried out until the diameter of the highly magnetic fine grains eventually corresponds to that of a unit magnetic domain. Therefore, extrusion rate for each plastic deformation and the number of repetition of the plastic deformation are designed in reference to the initial particle size. Annealing is usually applied to the work piece after each plastic deformation. It is also usual that, after a certain plastic deformation is over, a plurality of work pieces reduced in diameter in that plastic deformation are bundled together for a next plastic deformation. Here, the size of the unit magnetic domain, i.e. the critical radius, differs depending on the kind of the highly magnetic substance. It is roughly 8 to 15 mm. for Fe, 37 mm. for Co and 27 mm. for Ni.

Since the nonmagnetic substance used for the plating is very strongly bonded to the highly magnetic powder particles, no slip occurs at the border between the two substances during plastic deformation. Consequently external force acting on the sintered body is uniformly and sufficiently transmitted to the highly magnetic particles so that the particles can be well deformed monolithically with the nonmagnetic substance plated on them. As a result, the highly magnetic powder particles can be microminiaturized uniformly whilst being wholly covered with the nonmagnetic base. It is believed also that the total covering of the highly magnetic particles with the nonmagnetic substance well contributes to absence of slip at the border between the two. For these reasons, the above-described monolithical deformation occurs even when the nonmagnetic substance is poorer in deformation resistance than the highly magnetic particles it covers.

The exquisitely microminiturized and oriented arrangement of the highly magnetic fine grains within the nonmagnetic base assures high coersive force Hc, residual magnetic flux density Br and maximum magnetic energy product (BH) max of the produced hard magnetic material.

In accordance with the process of the present invention, the highly magnetic metal used for the starting substance is already powdered to an appreciable particle size and such advanced minituarization of the starting substance greatly reduces the number of repetition of the subsequent plastic deformation necessary for further microminiaturization to the unit magnetic domain level when compared with the above-described previously proposed process. In other words, it is no longer required to employ a large deformation ratio for each plastic deformation and, therefore, choice of substance is no longer restricted by deformability of the substance.

Further, presence of the subsequent microminiaturization allows use of a starting substance of a particle size significantly larger than that of the unit magnetic domain. This enables easy preparation of the highly magnetic substance, and ideal filtering of the highly magnetic powder particles. The large particle size also precludes, or to say the least diminishes, the oxidization problem during the preparation. Even when the particles are oxidized during the preparation, the oxidized shells are removed through contact with sulfuric acid during the plating with nonmagnetic substance. These effects concur in order to greatly improve the magnetic characteristics of the produced hard magnetic material.

fter the plating, the highly magnetic particles are rtified against oxidization with the nonmagnetic shells nbracing them so that no oxidization should occur ıring the subsequent compaction and sintering. Conseıently, the high magnetic particles are free from enrgement in deformation resistance which otherwise riously disables uniform deformation.

EXAMPLE

This example is illustrative of the present invention ıt not to be construed as limiting the same.

Carbonyl Fe powder particles of 99.5% purity, 5 μm /erage diameter and 3 to 7 μm grain size distribution as used for the highly magnetic substance. These carnyl Fe powder particles were plated with Cu by nelectrolytic plating so that the resultant Fe volume cupation ratio should be 59%. The plated Fe particles ere filled into a rubber casing of 100 mm. diameter and 000 mm. length for hydrostatic compaction at 3,000 g/cm$^2$ pressure. The compressed body was then subcted to sintering at 750° C. for 1 hour within $H_2$ gass ıvironment. Hydrostatic extruction was applied to the ntered body at 13,000 kg/cm$^2$ pressure and 25:1 rate of oss-sectional reduction, which was followed by aneaing at 650° C. for 30 min. Hydrostatic extruction ıd annealing were alternately repeated until 6.25×10$^4$ rate of cross-sectional reduction was finally ached. The produced hard magnetic material inuded Fe fine grains having almost uniform diameter of out 20 mm. As a result of magnetic characteristics easurement, it was confirmed that the hard magnetic aterial was 1.1 T in residual magnetic flux density, ,000 A/m in coercive force, and 47,000 AT/m in aximum magnetic energy product.

COMPARATIVE EXAMPLE

An Fe rod of 99.99% purity and 2 mm. diameter was nfined into a Cu cylinder of 2.8 mm. outer diameter ıd 2 mm. inner diameter in order to form a composite ody. A plurality of such composite bodies were filled to a Cu cylindrical container of 150 mm. outer diamer and 140 mm. inner diameter, which was then closed. ext, the container was subjected to hydrostatic extrucon at 100:1 rate of cross-sectional reduction, which as filled by annealing under process conditions same that in the example of the present invention. Hydrostatic extruction and annealing were repeated until 1/1×10$^{10}$ rate of cross-sectional reduction was finally reached. The obtained hard magnetic material was 1.0 T in residual magnetic flux density, 37,000 A/m in coercive force, and 18,000 AT/m in maximum magnetic energy product.

As is clear from the foregoing comparison, the process of the present invention assures stable production of hard magnetic material provided with highly improved magnetic characteristics at remarkably low production cost. In addition, it does not call for use of expensive metals such as Co, thereby lowering the material cost for production of such hard magnetic material.

We claim:

1. A process for producing hard magnetic material comprising plating powder particles of highly magnetic substance selected from the group consisting of Fe, Co, Ni and alloys thereof with nonmagnetic substance selected from the group consisting of Cu, Al, Sn, Pb, Zn and combination of these metals to form plated particles, said powder particles having a diameter from about 1 to about 1000 microns; compacting the plated particles; sintering the resulting compact; and subjecting the sintered compact to plastic deformation in a prescribed direction, thereby dispersing and orienting in said prescribed direction fine grains of said highly magnetic substance within a base of said nonmagnetic substance, each fine grain corresponding in size to the unit magnetic domain.

2. A process as claimed in claim 1 in which the combination of said highy magnetic and nonmagnetic substances is chosen from a group consisting of Fe with Cu at 10 to 85 volume occupation ratio of Fe, Fe with Pb at 10 to 85 volume occupation ratio of Fe, Fe with Sn at 10 to 80 volume occupation ratio of Fe, and Fe with Zn at 10 to 80 volume occupation ratio of Fe.

3. A process as claimed in claim 1 in which said diameter of said powder particle is in a range from 5 to 150 μm.

4. A process as claimed in claim 1, or 2, in which said plastic deformation is carried out by hydrostatic extrusion.

* * * * *